US006254353B1

(12) United States Patent
Polo et al.

(10) Patent No.: US 6,254,353 B1
(45) Date of Patent: Jul. 3, 2001

(54) METHOD AND APPARATUS FOR CONTROLLING OPERATION OF A SUBMERSIBLE PUMP

(75) Inventors: Massimo Polo, Preganziol; Stefano Cavagna, Belluno, both of (IT); Robert M. Gamber; Charles E. Konrad, both of Roanoke, VA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/395,634

(22) Filed: Sep. 14, 1999

Related U.S. Application Data

(60) Provisional application No. 60/103,271, filed on Oct. 6, 1998.

(51) Int. Cl.[7] ..... F04B 49/06

(52) U.S. Cl. ..... 417/44.11; 417/53; 318/280; 73/152.01

(58) Field of Search ..... 417/44.11, 53; 340/18; 318/280; 73/152.01

(56) References Cited

U.S. PATENT DOCUMENTS

| | | | | |
|---|---|---|---|---|
| 2,972,708 | | 2/1961 | Schaefer . | |
| 3,283,236 | | 11/1966 | Legg . | |
| 3,417,290 | | 12/1968 | Craddock . | |
| 4,021,700 | | 5/1977 | Ellis-Anwyl . | |
| 4,038,632 | * | 7/1977 | Parker | 340/18 |
| 4,107,987 | * | 8/1978 | Robbins et al. | 73/151 |
| 4,157,535 | * | 6/1979 | Balkanli | 340/18 |
| 4,157,659 | * | 6/1979 | Murdock | 73/151 |
| 4,200,829 | | 4/1980 | Pohl . | |
| 4,224,652 | | 9/1980 | Fiorentzis . | |
| 4,242,712 | | 12/1980 | Doll . | |
| 4,284,943 | | 8/1981 | Rowe . | |
| 4,523,248 | | 6/1985 | Schmale et al. . | |
| 4,538,220 | | 8/1985 | Gyugyi . | |
| 4,716,487 | | 12/1987 | Horvath et al. . | |
| 5,160,244 | | 11/1992 | Kuwabara et al. . | |
| 5,350,992 | | 9/1994 | Colter . | |
| 5,386,183 | | 1/1995 | Cronvich et al. . | |
| 5,508,620 | | 4/1996 | Pfiffner . | |
| 5,571,240 | | 11/1996 | Yamauchi et al. . | |
| 5,580,221 | | 12/1996 | Triezenberg . | |
| 5,670,852 | * | 9/1997 | Chipperfield et al. | 318/280 |

* cited by examiner

*Primary Examiner*—Charles G. Freay
(74) *Attorney, Agent, or Firm*—Carl B. Horton, Esq.; Damian Wasserbauer, Esq.; Armstrong Teasdale LLP

(57) ABSTRACT

A submersible pumping system which, in one embodiment, includes a motor, a pump and a control circuit, or unit, coupled to the motor for controlling the operation of the motor is described. Using motor and sensor signals, the control unit detects various conditions within the pumping system and alters motor operation. In an exemplary embodiment, the control unit initiates an oscillation sequence of applying a forward torque for a first preselected period of time, applying a reverse torque for a second preselected period of time, and then repeating the torque applying steps a selected number of times to eliminate an obstruction from the pump.

33 Claims, 9 Drawing Sheets

METHOD AND APPARATUS FOR CONTROLLING OPERATION OF A SUBMERSIBLE PUMP

CROSS REFERENCE TO RELATED APPLICATION

This application claims the benefit of U.S. Provisional Application No. 60/103,271, filed Oct. 6, 1998.

BACKGROUND OF THE INVENTION

This invention relates generally to electric motor driven submersible pumping systems and, more particularly, to methods and apparatus for controlling operation of a submersible pump.

Known deep well, residential service, submersible pumps typically are driven with two pole, alternating current (AC) induction motors packaged for immersion in a well. The motors include a stator portion that is encapsulated with an epoxy to form a barrier impervious to moisture. The motor is enclosed in a housing assembly having water lubricated bearings. The enclosed assembly is filled with ethylene-glycol. An output shaft of the motor is directly coupled to a shaft of a pump that includes a stack of impellers to force water into an outlet pipe. The outlet pipe has a pressure level determined by the depth of the water level and the pressure level at the associated residence. A check valve in the pump outlet pipe prevents water from draining into the well when the pump outlet pressure is less than the pressure in the outlet pipe.

Motors for residential water pumping systems are typically rated at ¾ horsepower, have a 1.6 service factor, and thus have a net continuous rating of 1.2 horsepower. The motor and pump are coupled in line and typically fit into an outer casing four inches in diameter. The casing assembly has a total length of about three to four feet. Wiring and a supply pipe are attached to the pump and motor assembly before the pump and motor assembly are lowered into the well. The assembly is positioned a short distance from the bottom of the well to avoid sand and other contaminants from fouling the water inlet. Maximum operating depth can be up to 400 feet and the pump capacity is preferably sufficient to maintain 60 psi plus the pressure needed to overcome the up to 400 foot head.

The pumping system at the top of the well includes a storage tank with a spring loaded or air initiated bladder to minimize the change in pressure when the water level in the tank drops due to use by the residence. A pressure switch with adjustable hysteresis is interfaced to the storage tank to switch the pump "ON" when the pressure drops below a minimum set point and "OFF" when the pressure reaches a maximum set point.

The four inch pump-motor diameter requires a five inch well casing, which results in a substantial well drilling cost. In addition, if a well is pumped dry, the pump may be damaged because the bearings are water lubricated, and the lack of water leads to bearing failure unless a flow restrictor is added to the waterline at the well head to prevent the output flow from exceeding the well recovery rate. Further, sand, stone chips, or other debris in the well may cause the pump to seize or bind leading to a stalled motor condition that may cause motor overheating and damage. Still further, if line voltage is low, the motor is forced to operate at less than rated magnetic flux, thus requiring more current to produce the same torque, which may lead to motor overheating and the possibility of eventual failure. Also, use of an integrated gate bi-polar transistor pulse width modulation inverter as an induction motor drive may have a high output of electromagnetic interference. In addition, failure of the pump-motor results in an interruption of the potable water supply.

An AC induction motor typically has a pullout torque (maximum torque on the motor characteristic curve) which is 3 to 4 times the rated torque and a typical current at stall which is 5 to 6 times the rated current. In an application where the motor is started by simply connecting it across the power source using a switch or contactor, there is an initial inrush current of 5 to 6 times the rated current which gradually reduces to rated current as the motor accelerates to rated speed. During the acceleration, the torque increases with increased speed until the pullout torque speed is reached, after which the torque and current begin to fall as the speed increases further. The speed will settle to a constant value when the motor torque is equal to the load torque.

Torque loads presented to the motor by pumps and other variable speed loads, such as compressors and fans, vary with shaft speed. With these types of loads, the load torque at zero speed is very small and increases with increasing speed. The torque available to accelerate the load is the difference between the motor torque and the load torque. The ideal fan torque characteristic is a torque which varies with the square of speed. Pumps and compressors are oftentimes similar to the fan load torque, but in some instances may depart significantly from the ideal characteristics due to variations in back pressure, for example. In general, torque can be considered to be a function of slip frequency where a linear approximation has sufficient accuracy for most applications. If motor speed is known from a tachometer or other speed measuring device, then the controller, to produce a desired level of torque at that speed, calculates the frequency that would place the synchronous speed at the rotor speed and then adds to that frequency the slip frequency needed to produce the desired torque. For example, if the motor is running at 1800 rpm, 30 Hz excitation would make this the synchronous speed for a two pole motor. Typically, a slip frequency of 3 Hz provides 200% of rated torque so that providing 33 Hz excitation at this speed will result in 200% torque. This principle of control is usually referred to as slip control and is well known in the art.

In highly competitive markets, a tachometer or other speed sensor adds too much cost to a controller, and systems are built without speed sensing apparatus. A motor without speed sensing apparatus should change speed slowly to ensure that the motor continues to operate at slip frequencies equal to or less than the frequency corresponding to pullout torque. When the frequency source is an electronic unit where the maximum current determines the controller cost, the maximum current limit is typically set at about twice the required continuous current rating by cost constraints. If the frequency is allowed to increase significantly faster than the motor speed, the system may get into a state where the slip frequency is so high that the current limit causes the maximum torque developed to be significantly less than rated torque causing the motor to stall. If there is no speed measuring device, there may be no way for the controller to recognize that a stall has occurred and current will continue to be supplied at the limit value causing the motor to overheat and be damaged. While the description of this concern was based upon increasing the frequency too fast, the same state may arise as the result of load torque impulses, sticky shafts, and other anomalies that cause the motor shaft speed to drop.

Accordingly, it would be desirable to provide a motor that monitors the current flowing to the motor and adjusts the current in accordance with the present operating conditions. It also would be desirable to reduce the electromagnetic interference caused by the motor assembly and the controller. Further, it would be desirable to reduce the failures of the motor due to the motor becoming jammed with rocks and debris.

BRIEF SUMMARY OF THE INVENTION

These and other objects may be attained by a submersible pumping system which, in one embodiment, includes a motor, a pump coupled to the motor and a control circuit, or unit, coupled to the motor for controlling the operation of the motor. Using motor and sensor signals, the control unit can detect various conditions within the pumping system and alter the operation of the motor.

In one aspect, the present invention is directed to agitating the pumping system to overcome stalls caused by trapped debris or other forms of binding interference. In one embodiment, the control unit supplies pulse width modulation (PWM) signals to a three-phase AC motor coupled to a water pump. The control unit is arranged to provide PWM control of the motor so as to enable operation of the motor at speeds up to approximately 9,000 RPM. The motor and associated pump are reduced in physical size to about ⅓ the volume of conventional motor/pump systems running at conventional speeds of less than approximately 3600 RPM. The control unit controls motor operation based on water pressure at a bladder tank wherein a pressure sensor provides a signal indicative of pressure at a first lower setpoint for initiating motor operation and a signal indicative of pressure at a second upper setpoint for disabling motor operation. The control unit is preferably located outside the well and includes a rectifier for converting power from an AC power line to direct current (DC) power and a controllable inverter for converting the DC power to variable frequency AC power.

In another aspect, the present invention is directed to detecting whether the motor is in a stall condition and altering the operation of the motor to eliminate the obstruction causing the stall condition. More specifically, removing an obstruction in the pump includes the steps of applying AC power to the motor coupled to the pump, initiating a start sequence for the motor, monitoring the frequency of the motor, and comparing the motor frequency to a first preselected frequency to determine if the motor is in a stall condition. In addition, the method includes the step of initiating an oscillation sequence if the motor is in a stall condition. The oscillation sequence includes the steps of applying a forward torque for a first preselected time, applying a reverse torque for a second preselected period of time, and then repeating the torque applying steps a selected number of times. The oscillation sequence attempts to oscillate the rotation of the pump to dislodge any debris that may be lodged within the pump.

In yet another aspect, the present invention is directed to limiting current in the submersible pump induction motor. More specifically, limiting the current includes the step of comparing the motor current to a first preselected current and decreasing the motor speed if the motor current is greater than the first preselected current. In addition, the method includes the step of comparing the motor current to a second, lower, preselected current and increasing the motor speed if the motor current is less than the second preselected current. The method further includes the step of comparing the motor frequency to a preselected frequency and increasing the motor speed if the frequency is less than the preselected frequency.

The above described submersible pumping system detects multiple conditions and responds to those conditions by altering the operation of the motor. The control unit described above provides protection of the motor and improves operability of the submersible pumping system.

DETAILED DESCRIPTION OF THE INVENTION

Figure 1:
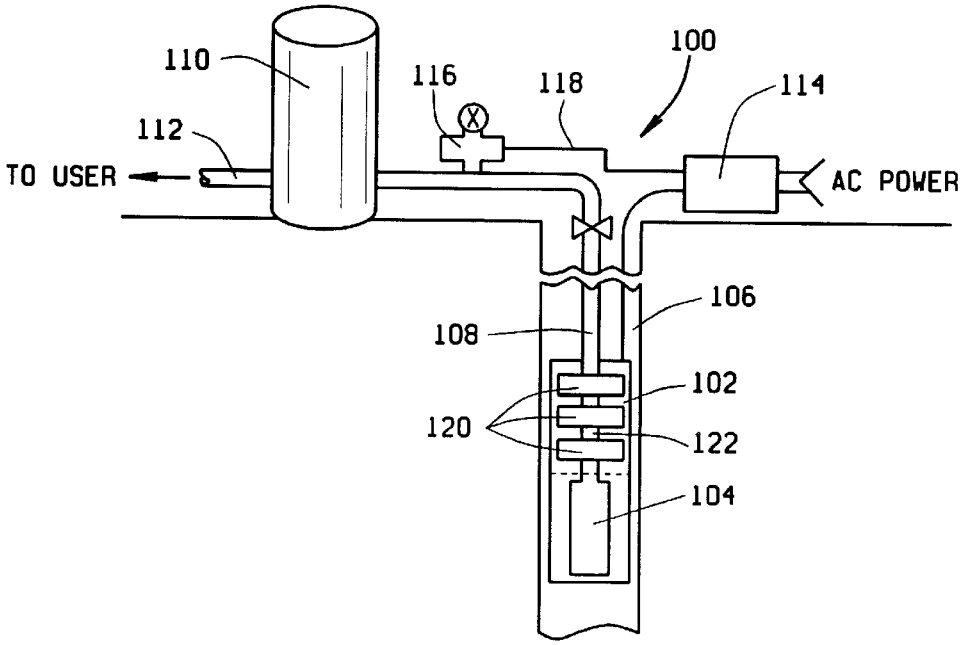
FIG. 1 is a schematic view of a deep well pumping system.
Figure 3:
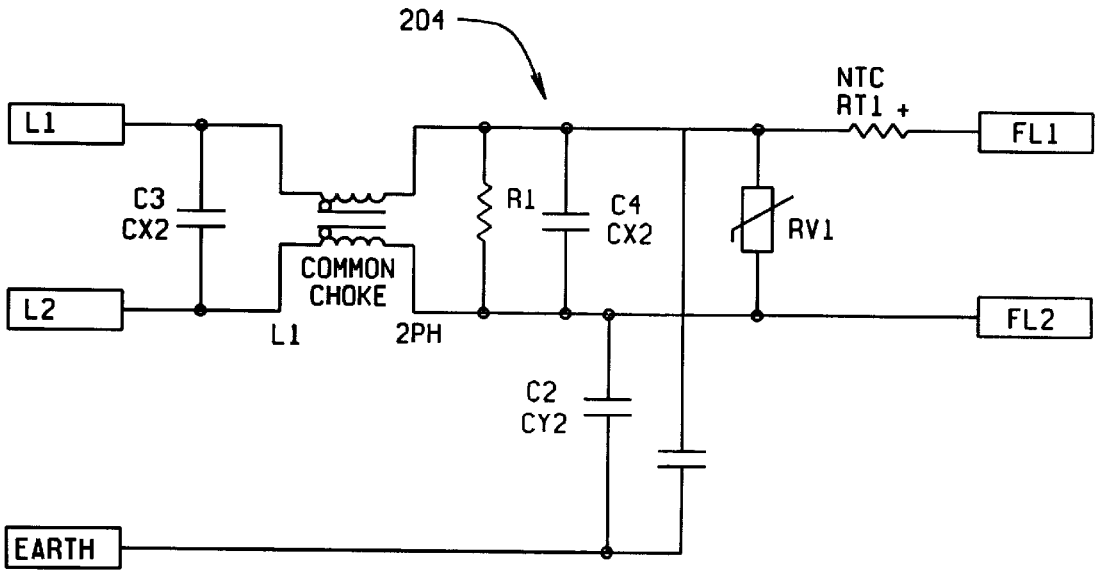
FIG. 3 is an exemplary input filter circuit as shown in FIG. 2.

FIG. 1 is a schematic view illustrating a deep well pumping system 100 including a pump 102 and an AC induction motor 104. Pump 102 and motor 104 are located within a bore 106 at a depth which may be up to, in one embodiment, about 400 feet. Water in bore 106 is pumped through a pipe 108 to a bladder type storage tank 110 from where it is distributed to a residential user via pipe 112. A control circuit, or unit, 114 responds to water pressure signals from a pressure sensor 116 via a line 118 for providing variable frequency AC excitation to motor 104. Control unit 114 receives power from conventional AC power utility lines as is well known in the art. When water pressure is less than a first preselected setpoint, sensor 116 provides a first signal which causes control unit 114 to energize motor 104. When the water pressure rises above a second higher preselected set point, sensor 116 provides a second signal which causes control unit 114 to remove excitation from motor 104.

Many functions and modifications of the components described above are well understood in the pumping system art. The present application is not directed to such understood and known functions and modifications. Rather, the present application is directed to the methods and structures described below in more detail. In addition, although the methods and structures are described below in the hardware environment shown in connection with FIG. 1, it should be understood that such methods and structures are not limited to practice in such environment. The subject methods and structures could be practiced in many other environments.

Pump 102 is typically a centrifugal pump comprising a plurality of impellers 120 stacked on a common shaft 122. The number of impellers needed to produce a given flow rate at a given pressure is inversely proportional to impeller speed. More particularly, if the impeller speed is increased by a factor of 3, the number of impellers can be reduced by the same ratio and produce the desired flow rate and pressure. Furthermore, it is generally known that motor power is equal to a constant multiplied by motor speed multiplied by motor volume. In other words, if motor speed is increased by a factor of 3, motor volume can be decreased by a factor of 3 and still yield the same output power. Accordingly, an increased motor speed will allow both the motor and pump to be reduced in size with concomitant reduction in cost. Further, installation cost may be reduced since the bore diameter for the well may be smaller.

Operating motor 104 at a higher speed, e.g., at 9,000 RPM rather than the conventional 3,600 RPM, requires an excitation frequency of about 150 Hz. Generating AC power at frequencies higher than normal power utility frequency, i.e., 60 Hz, requires an inverter. Preferably, such an inverter should be incorporated into control unit 114 and the total cost of control unit 114 should be sufficiently low so that the system cost (pump, motor and control unit) does not exceed the cost of a conventional 60 Hz system. Control unit 114 should also include the ability to minimize pressure variations in the residential water system and provide motor protection functions.

Figure 2:
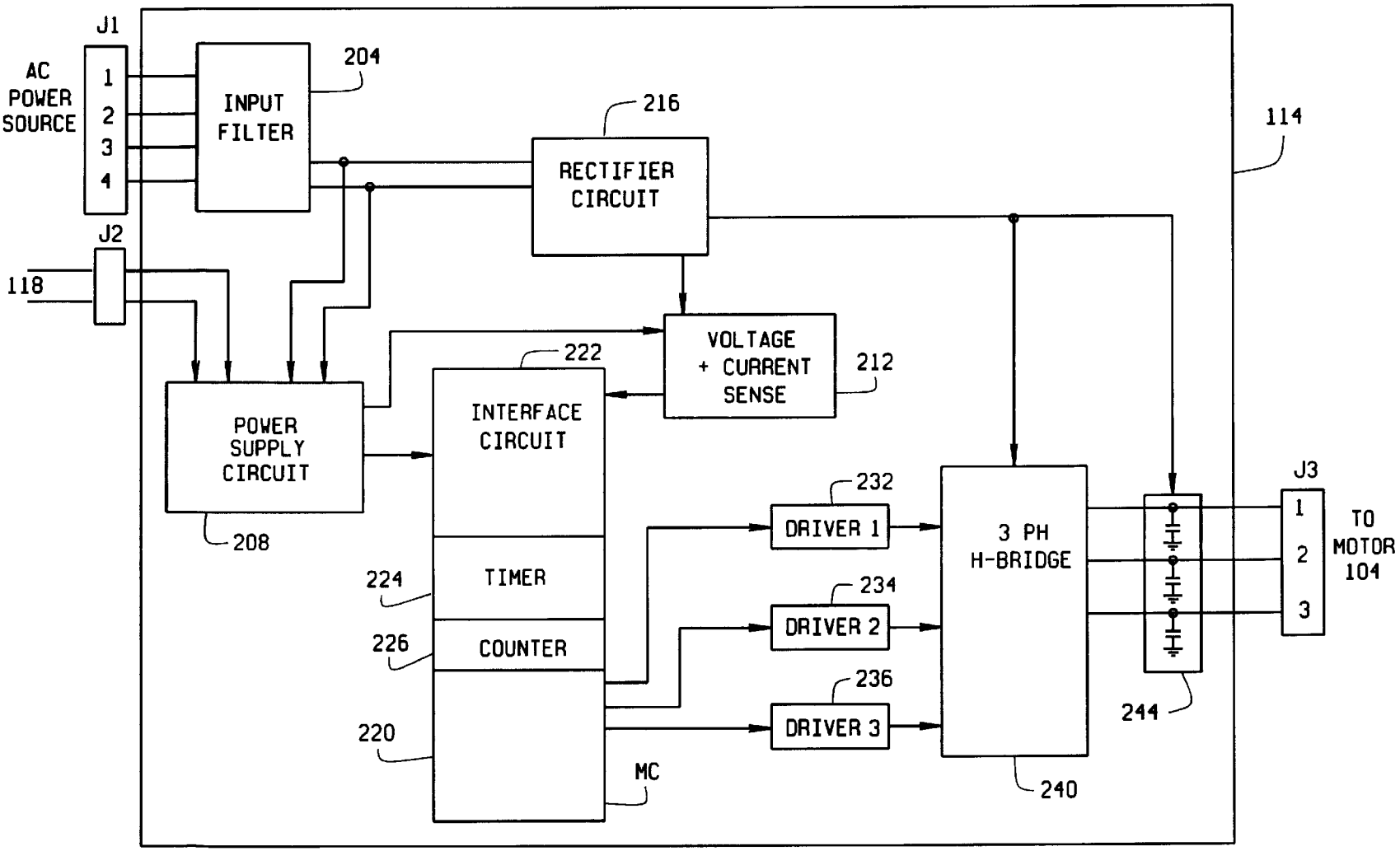
FIG. 2 is a block diagram of a control unit in accordance with one embodiment of the present invention.
Figure 4:
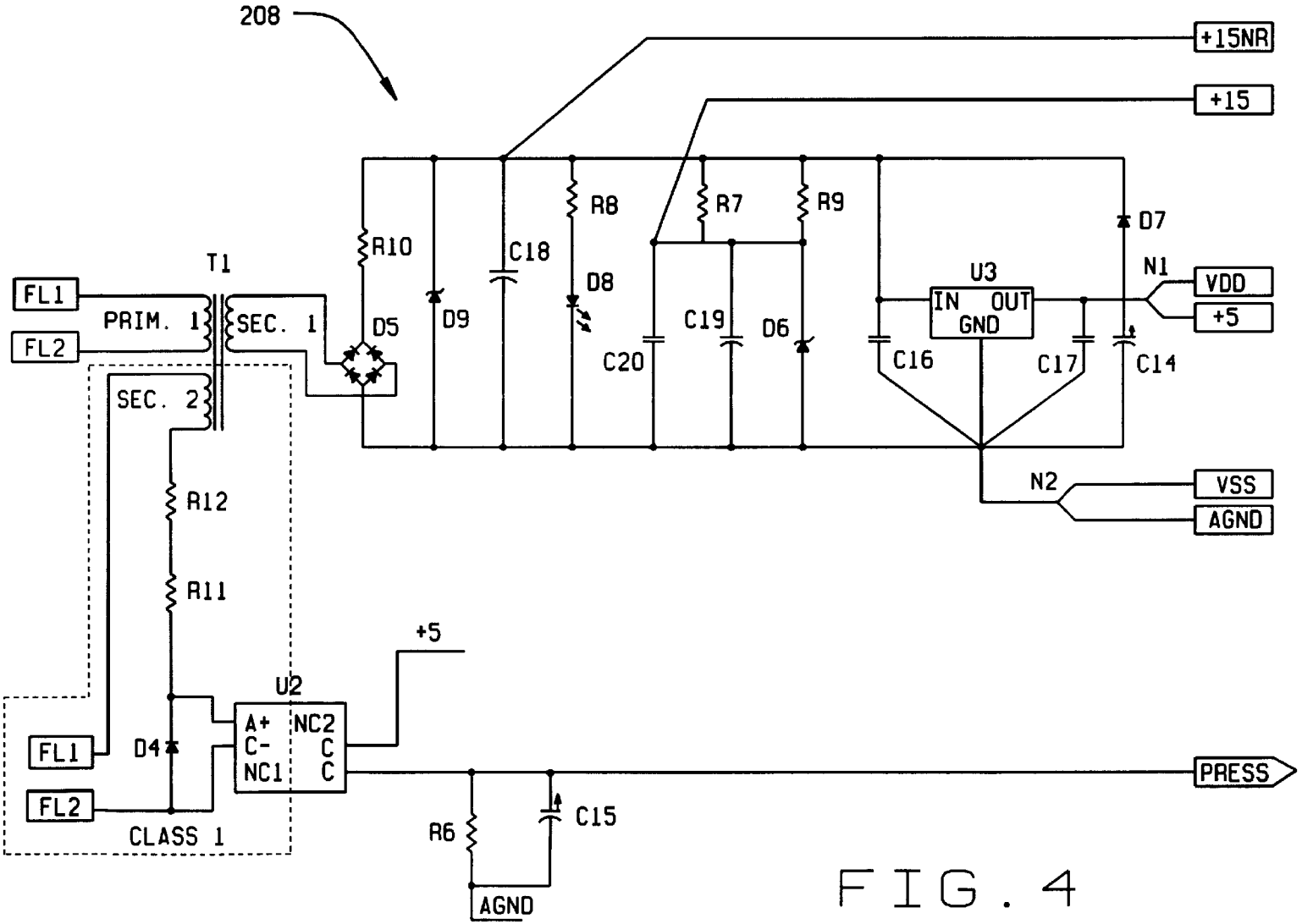
FIG. 4 is an exemplary power supply circuit as shown in FIG. 3.
Figure 5:
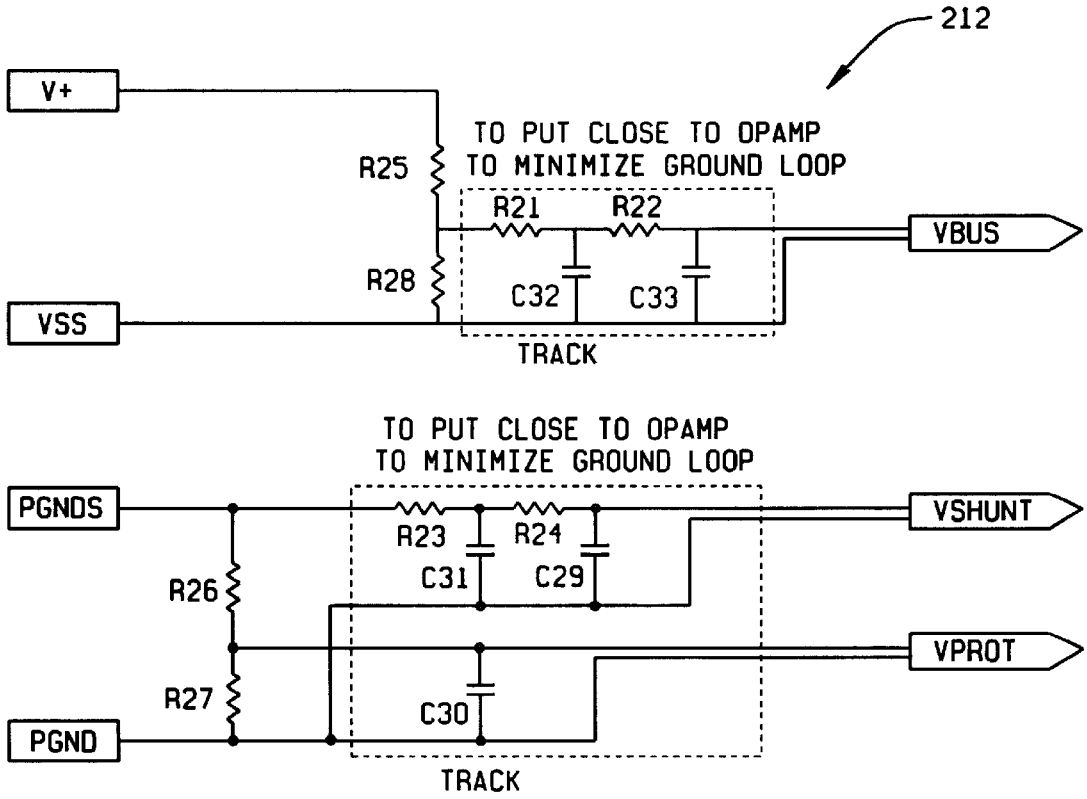
FIG. 5 is an exemplary voltage and current sense circuit as shown in FIG. 2.
Figure 6:
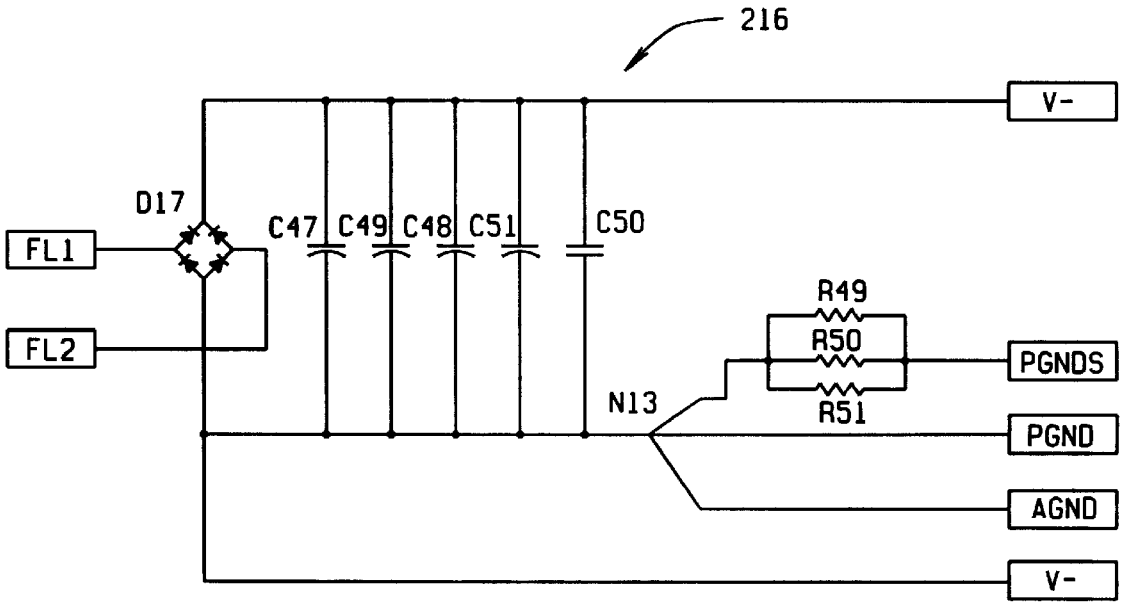
FIG. 6 is an exemplary rectifier circuit as shown in FIG. 2.
Figure 7:
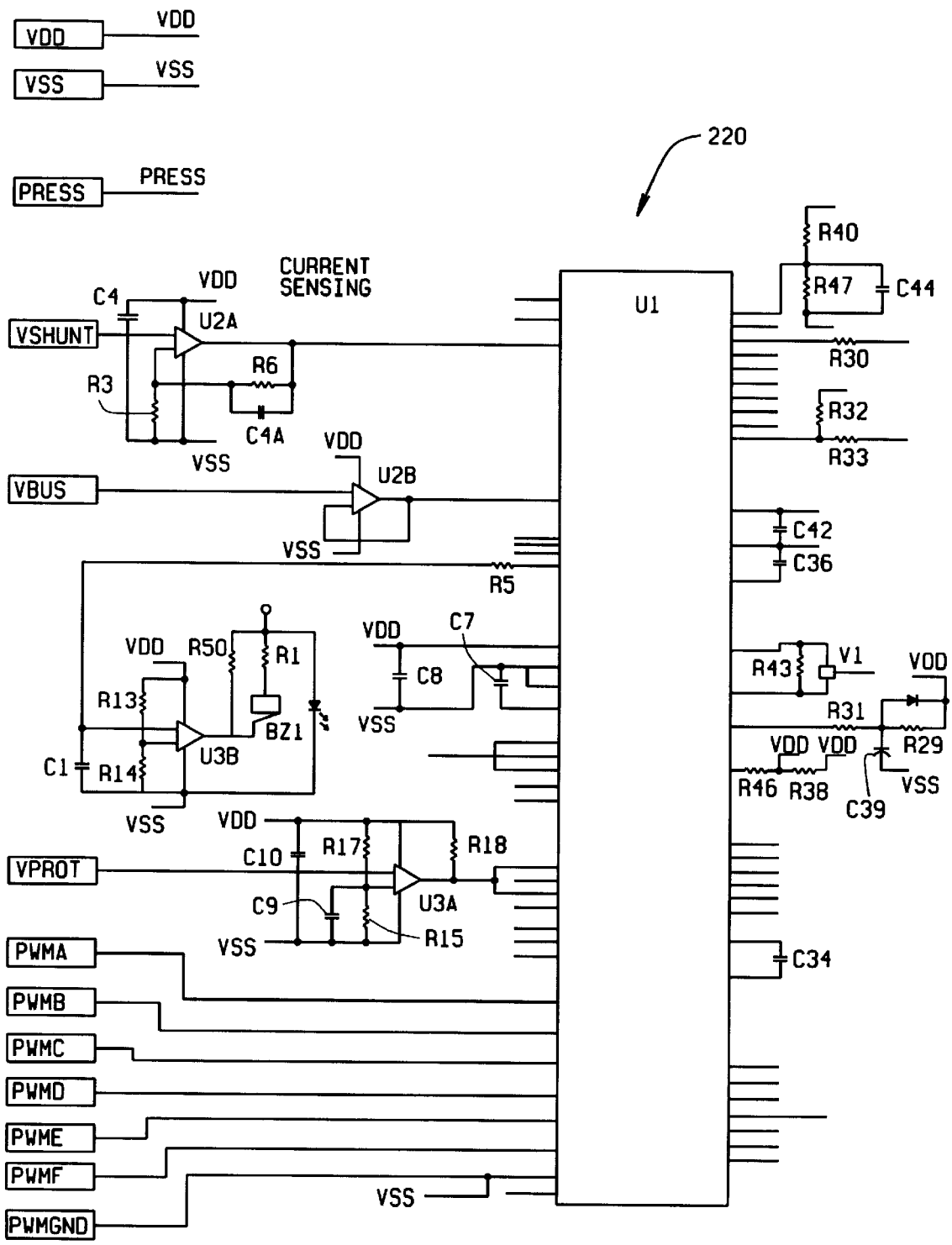
FIG. 7 is an exemplary microcontroller circuit as shown in FIG. 2.
Figure 8:
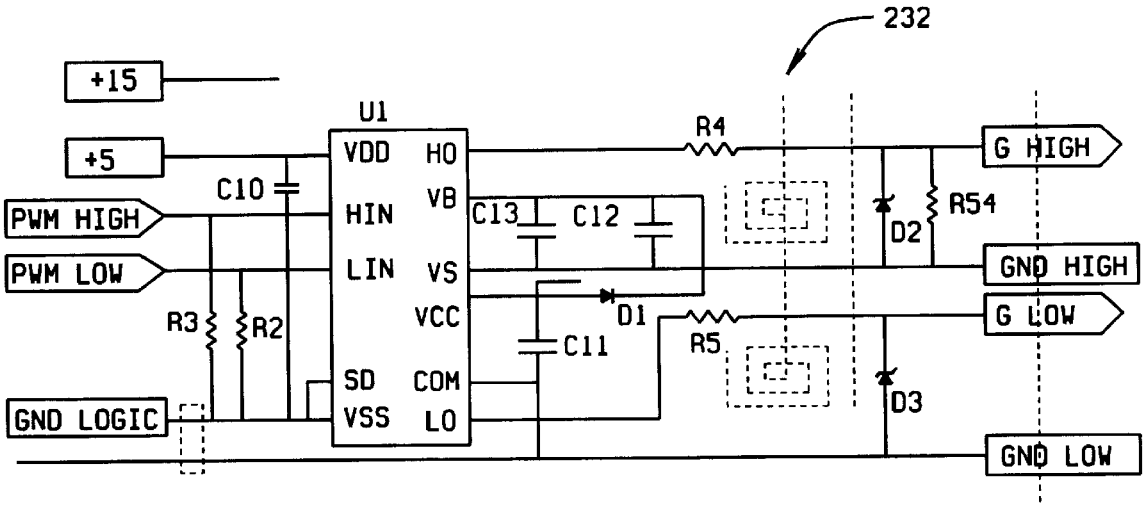
FIG. 8 is an exemplary driver circuit as shown in FIG. 2.
Figure 9:
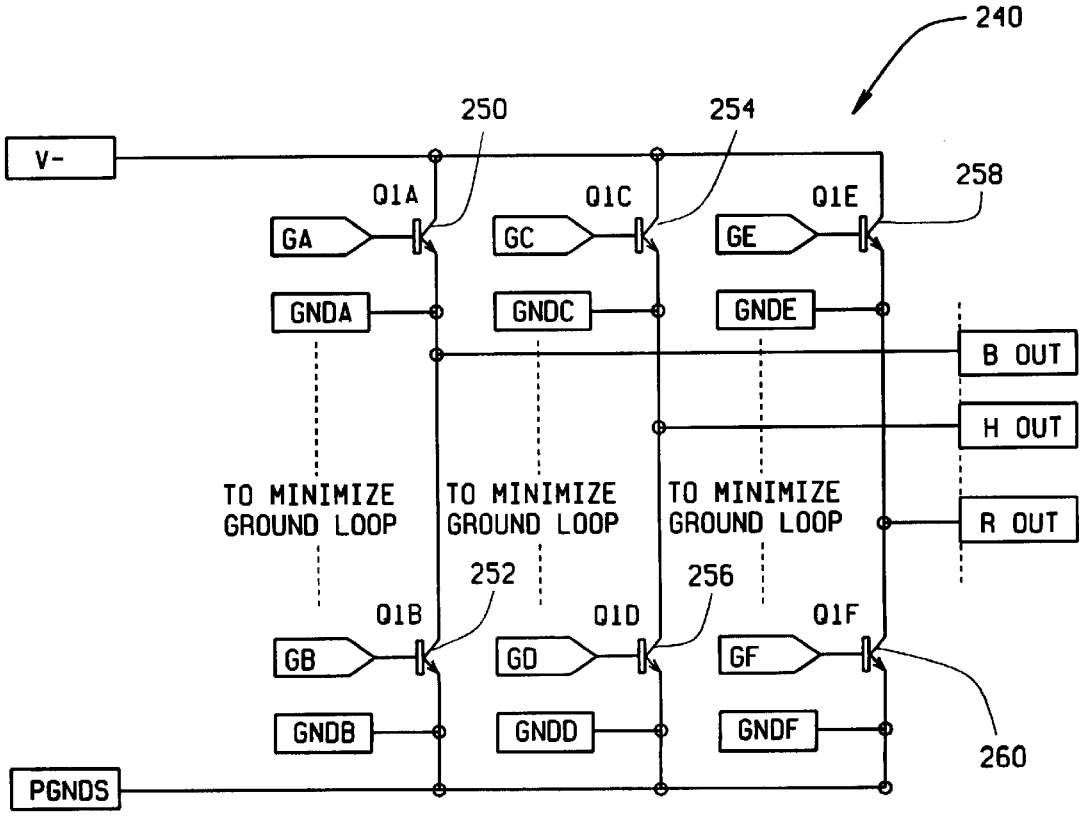
FIG. 9 is an exemplary H-bridge circuit as shown in FIG. 2.
Figure 10:
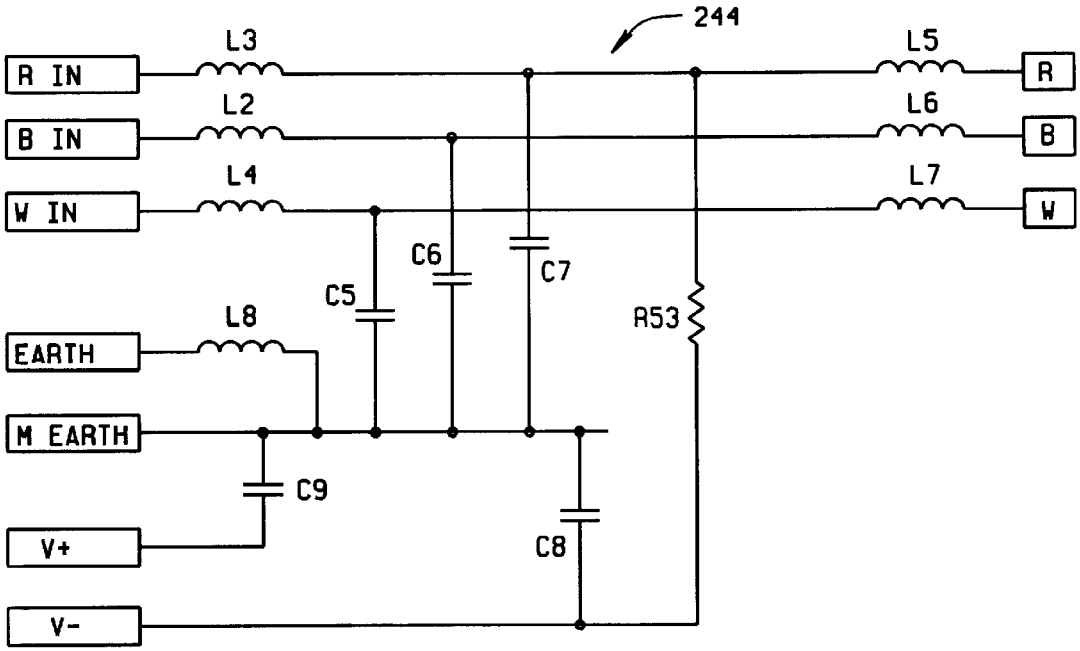
FIG. 10 is an exemplary output filter circuit as shown in FIG. 2.

FIG. 2 is a block diagram illustration of an exemplary control circuit, or unit, 114 in accordance with one embodiment of the present invention. Generally, control unit 114 couples to an AC power source (not shown) and pressure sensor 116 and based on the state of pressure sensor line 118 and signals exchanged with motor 104, control unit 114 determines operation of motor 104.

Referring now specifically to FIG. 2, control unit 114 includes an input filter 204, a power supply circuit 208, a voltage and current sense circuit 212, a rectifier circuit 216, and a microcontroller 220. The AC power source, e.g., 220 VAC, 60 Hertz (Hz), is supplied to connector JI which supplies AC power to input filter 204. Input filter 204 filters the noise from the AC power source so that filtered AC power is supplied to power supply circuit 208 and rectifier circuit 216. Power supply circuit 208 converts the filtered AC power to a plurality of DC voltages to be supplied to various components in control unit 114, for example, +5VDC, +15VDC and −15VDC. In addition, the pressure sensor signal from sensor 116 is supplied to control unit 114, specifically, power supply circuit 208, via connector J2 via line 118. Power supply circuit 208 converts the pressure sensor signal to an output pressure signal that is supplied to microcontroller 220. Rectifier circuit 216 includes a full-wave bridge rectifier and at least one filter capacitor (not shown in FIG. 2) for generating at least one DC motor supply voltage signal, for example, a motor positive supply voltage, V+, and a motor negative supply voltage V−. The DC voltages from power supply circuit 208 and the DC motor supply voltage signals from rectifier 216 are supplied to voltage and current sense circuit 212. Voltage and current sense circuit 212 uses the DC motor supply voltage and DC voltages from power supply circuit 208 to supply a Vbus signal, a Vshunt signal and a Vprot signal to microcontroller 220.

In one embodiment, microcontroller 220 includes an interface circuit 222, a timer 224 for measuring time, and a counter 226 for counting events. Interface circuit 222 is a circuit internal to microcontroller 220 that adjusts the Vbus, Vshunt, and Vprot signals to be supplied to analog to digital inputs (not shown) of microcontroller 220. Timer 224 and counter 226, in one embodiment, are contained within microcontroller 220 and respectively measures time in seconds and portions of seconds and is an incrementing counter. In one embodiment, microcontroller 220 is a Motorola MC68H708HP microcontroller.

Control unit 114 further includes at least one motor driver 232, a three phase H-bridge 240 and an output filter 244. In one embodiment, control unit 114, includes motor drivers 232, 234, and 236, where drivers 234 and 236 are identical to driver 232. Utilizing the signals supplied from circuits 208, 212 and 216, microcontroller 220 supplies output signals to drivers 232, 234 and 236. Output signals from drivers 232, 234 and 236 are supplied to H-bridge 240 which supplies motor drive signals to output filter 244. The filtered motor drive signals from output filter 244 are supplied to motor 104 via connector J3.

More specifically, microcontroller 220 supplies a plurality of pulse width modulation (PWM) signals to motor drivers 232, 234 and 236. The PWM signals supplied by microcontroller 220 are a series of increasing and decreasing modulation squarewaves so that electrical interference is minimized. In one embodiment as described below in more detail, microcontroller 220 generates a six step square waveform having a frequency that is a multiple of the fundamental frequency of motor 104. The output signals of drivers 232, 234 and 236, in one embodiment, drive, or control, insulated gate bipolar transistors (IGBT) 250, 252, 254, 256, 258, and 260 of H-bridge 240. In alternative embodiments, H-bridge IGBTs 250, 252, 254, 256, 258, and 260 are gate turn-off devices (GTO) or other suitable electronic switching elements.

Exemplary embodiments of circuits 204, 208, 212, 216, 220, 232, 240 and 244 are shown in respective FIGS. 3, 4, 5, 6, 7, 8, 9 and 10.

Submersible pumps installed in residential applications are typically the sole supply of potable water. Failure modes associated with these submersible pump systems should be mitigated so that they do not result in the interruption of the potable water supply. The introduction of a control unit controlled induction motor into the submersible pump system provides an opportunity to prevent some of the failures which may result in a loss of potable water. Since submersible pumps are installed in wells at a depth of up to about 400 feet, if the pump malfunctions, it can be very expensive for the owner.

One potential malfunction is that the pump may become jammed with rocks or debris and may not be able to start. To control the operation of motor 104 utilizing control unit 114, and in one embodiment, a motor control algorithm is loaded into control unit 114. Specifically, the algorithm is loaded, and stored, in memory of microcontroller 220. The algorithm is then executed by microcontroller 220. It should be understood that the present invention can be practiced with many alternative microcontrollers, and is not limited to practice in connection with just microcontroller 220. Therefore, and as used herein, the term microcontroller is not limited to mean just those integrated circuits referred to in the art as microcontrollers, but broadly refers to microcomputers, processors, microcontrollers, application specific integrated circuits, and other programmable circuits.

Figure 11:
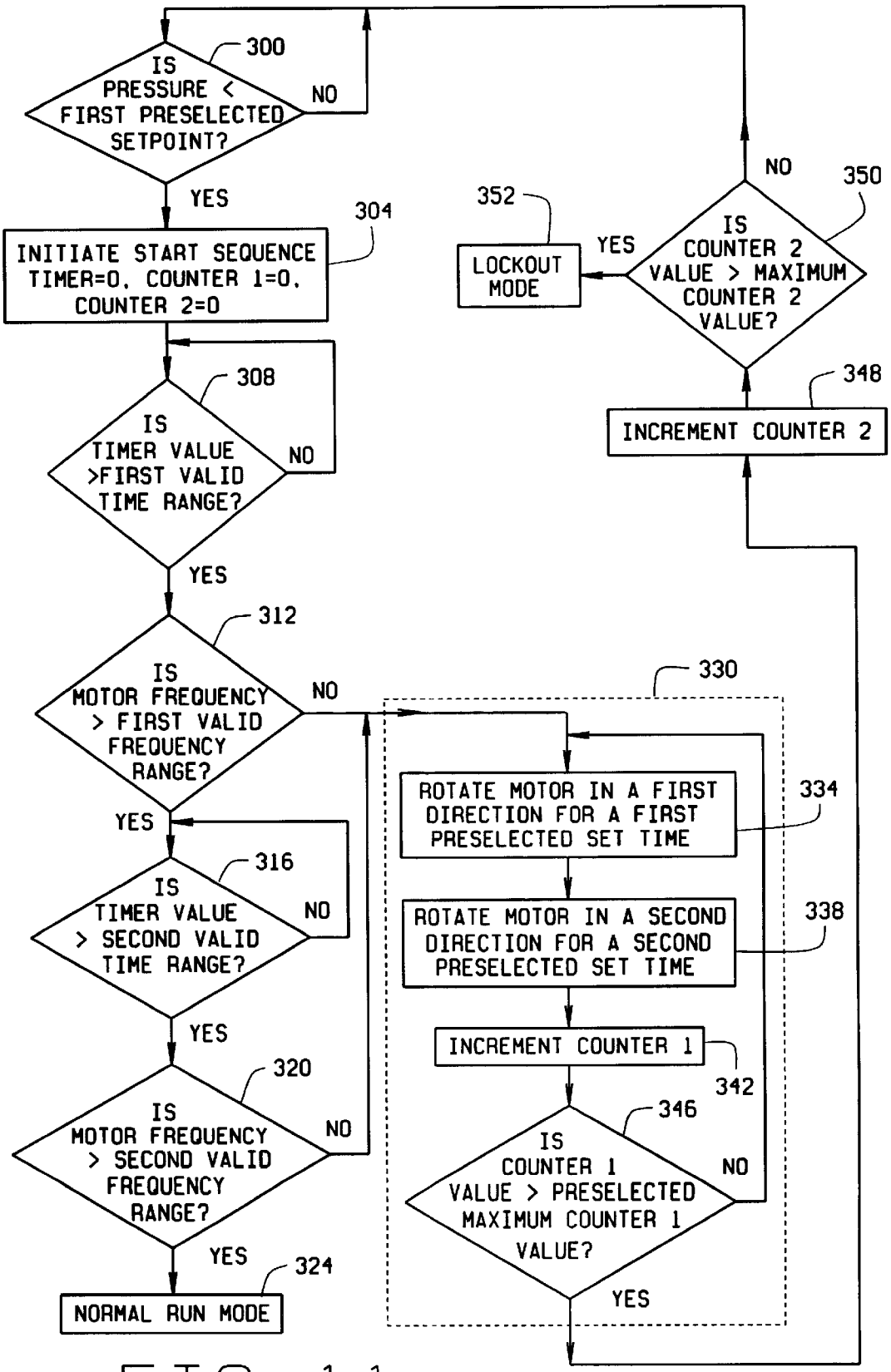
FIG. 11 is a flow chart of operation of the motor in accordance with one embodiment of the present invention.

A flow chart illustrating process steps executed by microcontroller 220 in controlling motor 104 is set forth in FIG. 11. More specifically, and in one embodiment, microcontroller 220 remains in an idle or standby mode until the water pressure falls below the first preselected set point. After microcontroller 220 detects pressure switch closure 300, by detecting a change in the state of line 118 from sensor 116, a start sequence 304 is initiated. During start sequence 304, signals are supplied to motor 104 to rotate motor 104, counter 226 counter 1 and counter 2 values are initialized to zero and timer 224 is initialized to zero and started to increment. Particularly, microcontroller 220 supplies PWM signals to drivers 232, 234 and 236 so that H-bridge 240 supplies motor drive signals to motor 104 via output filter 244 and connector J3.

Specifically and in one embodiment, microcontroller 220 supplies PWM output signals to drivers 232, 234 and 236 so that a six step square waveform is supplied to induction motor 104 via H-bridge 240. The switching frequency of motor drive signals to drivers 232, 234 and 236 is supplied to motor 104 via H-bridge 240 at up to six times the maximum fundamental frequency of motor 104. More specifically, the speed of motor 104 is controlled by converting the 220 VAC, 60 HZ input power supplied via connector J1 to a variable frequency 220 VAC output power. Control unit 114, specifically rectifier circuit 216, rectifies the incoming AC power and supplies a stable DC voltage source (V+) to IGBTs 250, 252, 254, 256, 258, and 260. IGBTs 250, 252, 254, 256, 258, and 260, in one embodiment, operate as high speed switches. The three phase variable frequency control output voltage is synthesized from the stable DC voltage source by microcontroller 220 for controlling the opening and closing of IGBT switches 250, 252, 254, 256, 258, and 260 via drivers 232, 234, and 236. The voltage, frequency, magnitude and phase rotation of signals to motor 104 are determined by the sequence and timing that IGBT switches 250, 252, 254, 256, 258, and 260 are opened and closed. This sequence and timing is defined in part by the modulation technique used by microcontroller 220 of control unit 114.

Figure 12:
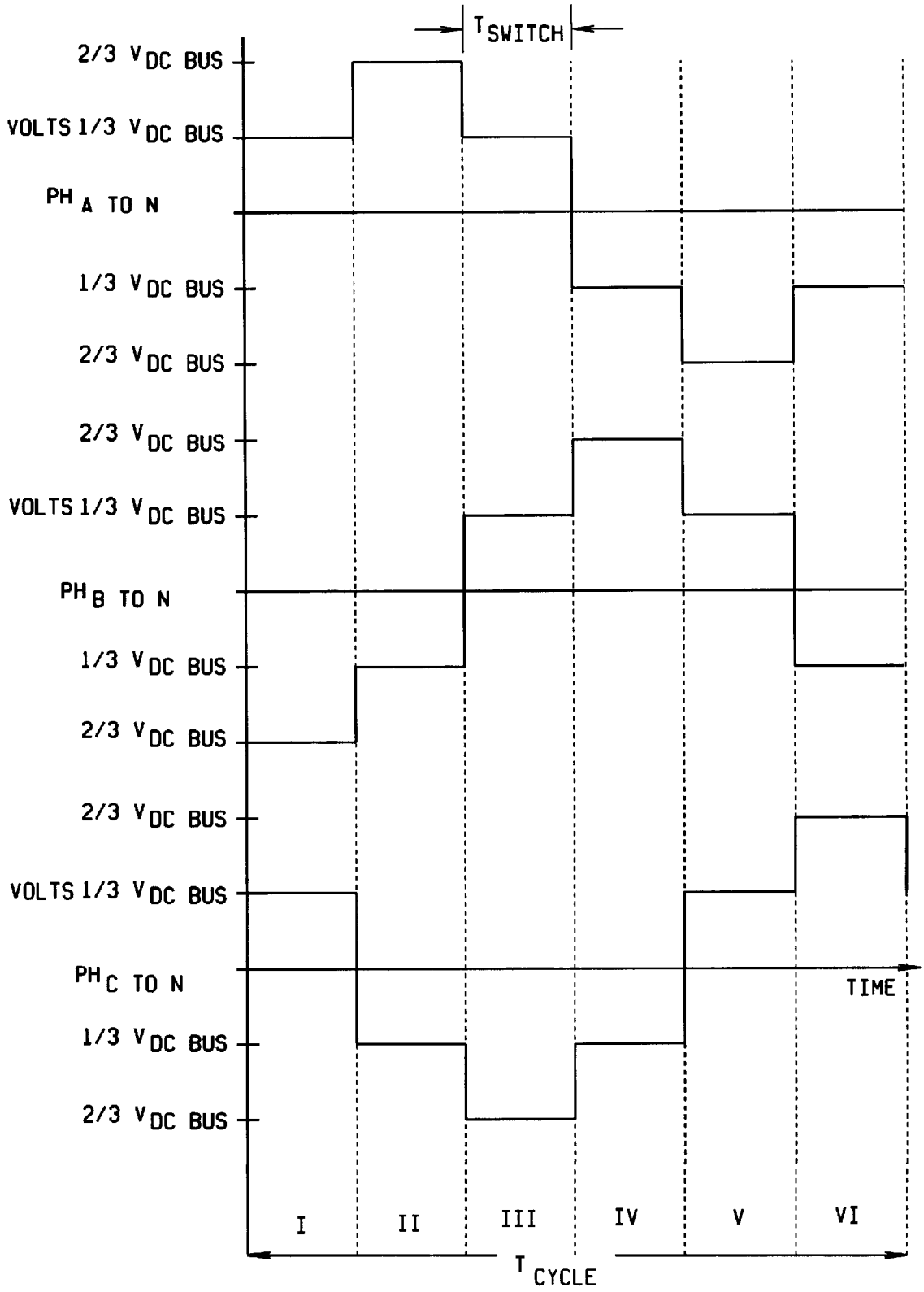
FIG. 12 is a waveform diagram of a six-step pulse width modulation signal in accordance with one embodiment of the present invention.

In one embodiment, sinusoidal pulse width modulation and six step square wave modulation techniques used by control unit 114. In one embodiment, sinusoidal pulse width modulation is used when the motor speed is either being increased or decreased within the range of 0 to 53% of the maximum speed. The sinusoidal pulse width modulation technique employs high frequency switching of IGBT switches 250, 252, 254, 256, 258, and 260. The advantage of pulse width modulation is superior control of motor voltage magnitude and frequency over a wide speed range. A requirement of induction motors used in variable speed applications is that the volts per hertz applied to the stator not exceed the saturation limits of motor 104. Thus, when operating at low speeds and low frequency the voltage magnitude usually must also be reduced. In another embodiment, radio interference is reduced by controlling the switching frequency of IGBT switches 250, 252, 254, 256, 258, and 260 via drivers 232, 234, and 236 with a six-step square wave operation having a switching frequency which is six times motor 104 maximum fundamental frequency. By using the six-step square wave modulation electromagnetic interference which causes disturbances in the reception of AM radio or television signals is reduced. For example, where the maximum fundamental frequency of motor 104 is 150 HZ, a maximum modulation switching frequency of 900 HZ is used. FIG. 12 shows phases A, B and C line to neutral motor voltages created by six step square wave modulation on a three phase wye connected motor. In one embodiment, by altering the signals supplied to drivers 232, 234, and 236, H-bridge 240 supplies six discreet voltage steps to motor 104. The six voltage steps are shown in FIG. 12 as roman numerals I thru VI. Each step represents a unique state of IGBT switches 250, 252, 254, 256, 258, and 260. The switch states of IGBT switches 250, 252, 254, 256, 258, and 260 are shown in Table 1 and are labeled I thru VI to correspond to the voltages shown in FIG. 12.

TABLE I

| | IGBT 250 | IGBT 252 | IGBT 254 | IGBT 256 | IGBT 258 | IGBT 260 |
|---|---|---|---|---|---|---|
| I | Closed | Open | Open | Closed | Closed | Open |
| II | Closed | Open | Open | Closed | Open | Closed |
| III | Closed | Open | Closed | Open | Open | Closed |
| IV | Open | Closed | Closed | Open | Open | Closed |
| V | Open | Closed | Closed | Open | Closed | Open |
| VI | Open | Closed | Open | Closed | Closed | Open |

A switch state is defined as three of six IGBT switches 250, 252, 254, 256, 258, and 260 closed at any given time with the conditions that three switches may never be connected to the same rail (V+ and PGNDS in FIG. 9) and switches diametrically opposed to each other, e.g. 250 and 252; 254 and 256; and 258 and 260, can not be closed at the same time. A switch state connects the positive and negative DC voltage rails across the motor windings. As shown in FIG. 12 the voltage supplied to any phase of motor 104 by a switch state can be either ⅓rd or ⅔rd of the DC bus voltage (V+) in either positive or negative polarity. Switch state I shown in Table I shows the motor phase impedance connected across the DC bus by the IGBT switches 250, 256 and 258. The impedance in each motor phase is assumed to be equal. Motor phases A and C are connected in parallel between the neutral point and the positive DC rail. Motor phase B is connected between the motor neutral point and the negative DC rail. Accordingly the impedance from the positive DC rail to the neutral point is ⅓rd of the total impedance across the DC bus and accordingly the voltage across these two points is ⅓rd. The six step square waveform supplied by control unit 114 to motor 104 reduces the level of radio interference.

After initiating start sequence 304, the output of the timer is monitored to determine 308 whether the value of the timer exceeds a first valid time range, i.e., Time Start. For example, the timer may be monitored by microcontroller 220 until the timer value, Time Start, exceeds six seconds. Once the timer value exceeds the first valid time range, microcontroller 220 determines 312 if the frequency of motor 104 exceeds a first valid frequency range, e.g., Freq. If the determined frequency value exceeds the first valid frequency time range, microcontroller 220 determines 316 if the timer exceeds a second valid range. For example, the timer may be monitored by microcontroller 220 until the timer value exceeds fourteen seconds.

Once the timer value exceeds the second valid time range, microcontroller 220 determines 320 if the frequency of motor 104 exceeds a second valid frequency range. If the determined frequency value exceeds the second valid frequency range, microcontroller 220 operates 324 motor 104 in a normal run mode. For example, in one embodiment, the first valid frequency range is 50 Hz and the second valid frequency range is 120 Hz.

If, however, the determined 312 value of the frequency does not exceed the first valid frequency range or the determined 320 value of the frequency does not exceed the second valid frequency range, microcontroller 220 executes an oscillation sequence 330. Oscillation sequence 330 oscillates the direction of motor 104 to dislodge any debris that may be lodged within pump 102. More specifically, drive signals are supplied to motor 104 so that motor 104 rotates in a first direction, e.g., forward, for a first preselected period of time 334, e.g., one second. Microcontroller 220 then alters the signals supplied to H-bridge 240 via drivers 232, 234, and 236 so that the direction of motor 104 is reversed 338 and rotates in a second direction for a second preselected period of time. In one embodiment, the first preselected period of time and the second preselected period of time are equal. After reversing the direction for the second preselected period of time, microcontroller 220 increments 342 the counter 1 value of counter 226 by one and determines 346 if the counter 1 value exceeds a preselected maximum counter 1 value, e.g., counter 1 value is incremented by one and it is determined if the counter 1 value exceeds, for example 7.

If the counter 1 value is less than or equal to the preselected maximum counter value, microcontroller 220 alters the signals supplied to H-bridge 240 via drivers 232, 234 and 236 reversing 334 the direction of motor 104 to the first direction, e.g., forward, for the first preselected period of time. As described above, microcontroller 220 then alters the signals supplied to H-bridge 240 via drivers 232, 234 and 236 reversing 338 the direction of motor 104, e.g., reverse, for the second preselected period of time. After incrementing 342 counter 226 counter 1 by one, microcontroller 220 again determines 346 if the counter 1 value exceeds the preselected maximum value. If the counter value 1 does not exceed the maximum value the above described process is repeated. If, however, the counter 1 value exceeds the preselected maximum counter 1 value, the value of counter 226 counter 2 is incremented 348 by, for example, one. After incrementing 348 counter 2, microcontroller 220 determines 350 if the value of counter 2 exceeds a preselected counter 2 maximum value. If the counter 2 value exceeds the counter 2 maximum value, microcontroller 220 enters a lockout mode 352. If the counter 2 value does not exceed the maximum value, microcontroller 220 determines 300 if the pressure is less than the first preselected setpoint. For example, in one embodiment, where the preselected counter 2 maximum count is 7, the above described sequence will be repeated seven times and then control unit 114 will enter lockout mode 352. In one embodiment of the lockout mode, control unit 114 produces an audible beep or tone and power must be removed from control unit 114 to restart motor 104. The lockout mode prevents, or limits, damage to motor 104 caused by repeated reversing.

Figure 13:
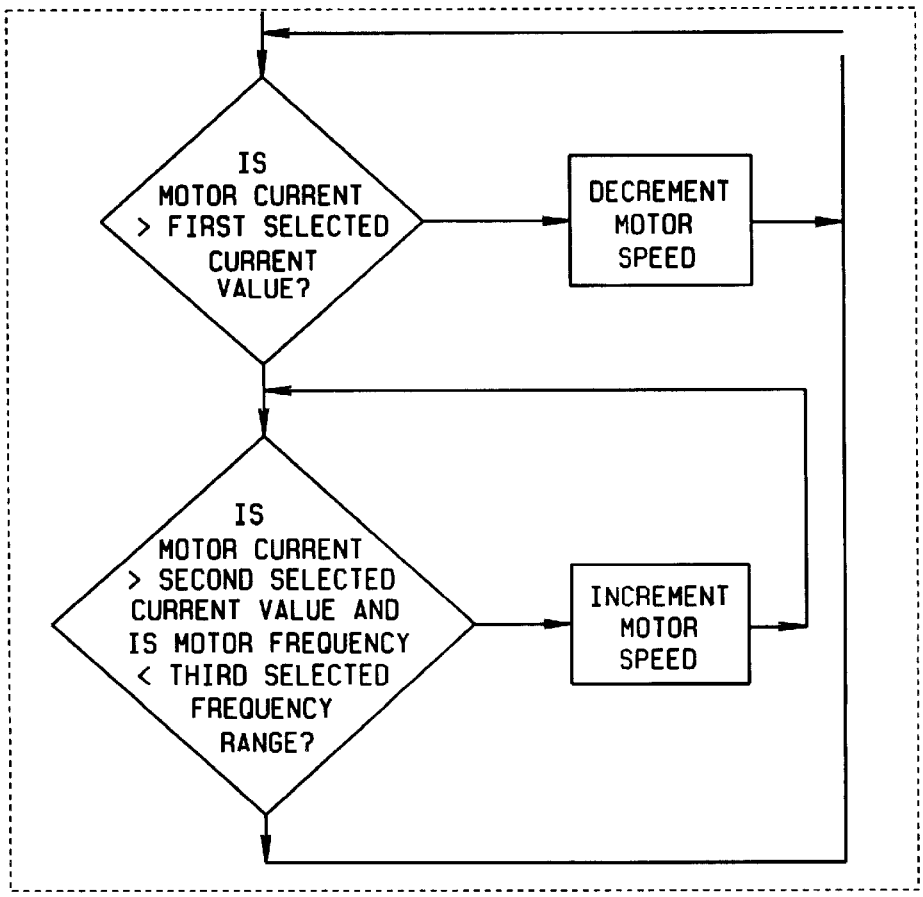
FIG. 13 is a flow chart depicting the normal run mode in accordance with one embodiment as shown in FIG. 11.

During normal run mode 324, control unit 114 controls the line current of motor 104 by altering motor speed. According to one embodiment, as shown in the flowchart set forth in FIG. 13, microcontroller 220 monitors the line current to motor 104 and alters the speed of motor 104 to limit the motor current. In a centrifugal pump, load is approximately proportional to the cube of speed. Thus relatively small reductions in speed can be very effective in limiting motor amps. The reduction in speed is of course accompanied by a loss of hydraulic performance that limits the amount the control may reduce the pump speed. The reduction in pump speed is determined by how much loss of hydraulic performance the typical submersible pump system can stand. In one embodiment, microcontroller 220 determines 400 if the line current to motor 104 exceeds a first selected current value, e.g., maximum line current of 4.5 amps. If the line current of motor 104 exceeds the first selected current value, the speed of motor 104 is decreased 404. More specifically, microcontroller 220 alters the signals to drivers 232, 234 and 236 so that the speed of motor 104 is decreased, by a selected value, e.g, 1 Hz. After decreasing the speed of motor 104, the line current of motor 104 is determined 400. The described process is repeated until the line current of motor 104 does not exceed the first selected current value.

Once the line current of motor 104 is equal to or below the first selected value, microcontroller 220 determines 408 if the line current of motor 104 is less than a second selected current value and if the frequency of motor 104 is less than a third selected frequency value. In one embodiment, the second preselected current is lower than the first preselected current. For example, the first preselected current is approximately 4.5 amps, the second preselected current is approximately 4.3 amps and the third selected frequency value is 150 Hz. If the line current of motor 104 is less than the second selected current value and the motor frequency is less than the third selected frequency value, the speed of motor 104 is increased. More specifically, microcontroller 220 alters the signals to drivers 232, 234 and 236 so that the speed of motor 104 is increased, by a selected value, e.g, 1 Hz.

After increasing the speed of motor 104, the line current and frequency of motor 104 is again determined 408. The described process is repeated until either the motor line current exceeds the second selected value and/or the motor frequency exceeds the third selected value. The speed of motor 104 is then monitored and adjusted within normal mode 324 by the determining 400 and 408 of motor 104 current and frequency. Control unit 114 thus has the ability to ride through some short term or long term over current situations without interrupting the potable water supply.

The above described control circuit or unit controls the operation of the induction motor. During operation, the control unit microcontroller monitors several parameters of the motor. In addition, based on these monitored parameters, the microcontroller alters the signals to the motor to maximize operability of the motor and the submersible pump.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, although the described control unit is described as utilizing a timer to determine whether certain events have occurred for a defined period of time, i.e., motor frequency exceeds a first frequency for first valid time range, other methods of determining the occurrence of the events may be used. More specifically, and in one embodiment, a counter may be used to determine whether the event has occurred for a defined number of counts. The counter value may be incremented on a time basis, i.e., every second, a number of events, i.e., rotations of the motor, or a random number, i.e., a random number generated by the microcontroller. Accordingly, the spirit and scope of the invention are to be limited only by the terms of the appended claims.

What is claimed is:

1. A method for operating a deep well pumping system including a pump, a motor coupled to the pump, and a control unit coupled to the motor, the control unit includes a timer for measuring time, said method comprising the steps of:

initiating a start sequence of the motor;

determining whether a timer value exceeds a first valid time range;

if the timer value exceeds the first valid time range, then determining whether a motor frequency is less than or equal to a first valid frequency range; and if the motor frequency does not exceed the first valid frequency range, then altering signals supplied to the motor.

2. A method in accordance with claim 1 further comprising the steps of:

if the motor frequency exceeds the first valid frequency range, then determining whether the timer exceeds a second valid time range;

if the timer value exceeds the second valid time range, then determining if the motor frequency does not exceed a second valid frequency range; and if the motor frequency does not exceed the second valid frequency range, then altering the signals supplied to the motor.

3. A method in accordance with claim 2 further comprising the steps of:

if the motor frequency exceeds the second valid frequency range, then determining whether the motor current exceeds a first selected current value; and if the motor current exceeds the first selected current value, then decreasing the speed of the motor.

4. A method in accordance with claim 3 further comprising the steps of:

if the motor current does not exceed the first selected current value, then determining whether the motor current is less than a second selected current value and determining whether the motor frequency is less than a third valid frequency range; and if the motor current exceeds the second selected current value and the motor frequency is less than the third valid frequency range, then increasing the speed of the motor.

5. A method in accordance with claim 2 wherein altering the signals supplied to the motor comprises the steps of:

a) applying a first direction torque to the motor to rotate the motor in a first direction; and b) applying a second direction torque to the motor to rotate the motor in a second direction.

6. A method in accordance with claim 5 wherein the control unit further includes a counter, and wherein said method further comprising the steps of:

c) incrementing the counter;

d) determining if a counter value does not exceed a preselected maximum counter value; and e) if the counter value does not exceed the preselected maximum counter value, then repeating steps a through d.

7. A method in accordance with claim 5 wherein applying the first direction torque to the motor comprises the step of applying the first direction torque to the motor for a first preselected period of time.

8. A method in accordance with claim 7 wherein applying the second direction torque to the motor comprises the step of applying the second direction torque to the motor for a second preselected period of time.

9. A method in accordance with claim 8 wherein the first preselected period of time equals the second preselected period of time.

10. A method in accordance with claim 1 wherein the control unit further includes a counter, and wherein initiating the start sequence of the motor comprises the steps of:

starting the timer;

initializing the counter to zero;

applying a series of signals to the motor so that the motor rotates in a first direction.

11. A method in accordance with claim 10 wherein applying the series of signals to the motor comprises the step of generating a six step square waveform utilizing the control unit.

12. A deep well pumping system including a pump, a motor coupled to said pump, and a control unit coupled to said motor, said control unit comprises a timer for measuring time, said system configured to:

initiate a start sequence of said motor;

determine whether a timer value exceeds a first valid time range;

if the timer value exceeds the first valid time range, then determine whether a motor frequency is less than or equal to a first valid frequency range; and if the motor frequency does not exceed the first valid frequency range, then alter signals supplied to said motor.

13. A system in accordance with claim 12 further configured to: if the motor frequency exceeds the first valid frequency range, then determine whether said timer value exceeds a second valid time range; if the timer value exceeds the second valid time range, then determine if the motor frequency does not exceed a second valid frequency range; and if the motor frequency does not exceed the second valid frequency range, then alter the signals supplied to said motor.

14. A system in accordance with claim 13 further configured to:

if the motor frequency exceeds the second valid frequency range, then determine whether the motor current exceeds a first selected current value; and if the motor current exceeds the first selected current value, then decrease the speed of said motor.

15. A system in accordance with claim 14 further configured to:

if the motor current does not exceed the first selected current value, then determine whether the motor current is less than a second selected current value and determine whether the motor frequency is less than a third preselected frequency range; and if the motor current exceeds the second selected current value and the motor frequency is less than the third valid frequency range, then increase the speed of said motor.

16. A system in accordance with claim 13 wherein to alter the signals supplied to said motor, said system configured to:

a) apply a first direction torque to said motor to rotate said motor in a first direction; and b) apply a second direction torque to said motor to rotate said motor in a second direction.

17. A system in accordance with claim 16 wherein said control unit further comprises a counter, and wherein said system further configured to:

c) increment said counter;

d) determine if a counter value does not exceed a preselected maximum counter value; and e) if the counter value does not exceed the preselected maximum counter value, then repeat steps a through d.

18. A system in accordance with claim 16 wherein to apply the first direction torque to said motor, said system configured to apply the first direction torque to said motor for a first preselected period of time.

19. A system in accordance with claim 18 wherein to apply the second direction torque to said motor, said system configured to apply the second direction torque to the motor for a second preselected period of time.

20. A system in accordance with claim 19 wherein the first preselected period of time equals the second preselected period of time.

21. A system in accordance with claim 12 wherein said control unit further comprises a counter, and wherein to initiate said start sequence of said motor, said system configured to:

start said timer;

initialize said counter to zero;

apply a series of signals to said motor so that said motor rotates in a first direction.

22. A system in accordance with claim 21 wherein to apply said series of signals to said motor, said system configured to generate a six step square waveform utilizing said control unit.

23. A control unit for a deep well pumping system including a motor coupled to a pump, said control unit coupled to the motor, said control unit comprises a timer for measuring time, said control unit configured to:

initiate a start sequence of the motor;

determine whether a timer value exceeds a first valid time range;

if the timer value exceeds the first valid time range, then determine whether a motor frequency is less than or equal to a first valid frequency range; and if the motor frequency does not exceed the first valid frequency range, then alter signals supplied to the motor.

24. A control unit in accordance with claim 23 further configured to:

if the motor frequency exceeds the first valid frequency range, then determine whether the timer value exceeds a second valid time range;

if the timer value exceeds the second valid time range, then determine if the motor frequency does not exceed a second valid frequency range; and if the motor frequency does not exceed the second valid frequency range, then alter the signals supplied to the motor.

25. A control unit in accordance with claim 24 further configured to:

if the motor frequency exceeds the second valid frequency range, then determine whether the motor current exceeds a first selected current value; and if the motor current exceeds the first selected current value, then decrease the speed of the motor.

26. A control unit in accordance with claim 25 further configured to:

if the motor current does not exceed the first selected current value, then determine whether the motor current is less than a second selected current value and determine whether the motor frequency is less than a third preselected frequency range; and if the motor current exceeds the second selected current value and the motor frequency is less than the third valid frequency range, then increase the speed of the motor.

27. A control unit in accordance with claim 24 wherein to alter the signals supplied to the motor, said control unit configured to:

a) apply a first direction torque to the motor to rotate the motor in a first direction; and b) apply a second direction torque to the motor to rotate said motor in a second direction.

28. A control unit in accordance with claim 27 wherein said control unit further comprises a counter and further configured to:

c) increment said counter;

d) determine if a counter value does not exceed a preselected maximum counter value; and e) if the counter value does not exceed the preselected maximum counter value, then repeat steps a through d.

29. A control unit in accordance with claim 27 wherein to apply the first direction torque to the motor, said control unit configured to apply the first direction torque to the motor for a first preselected period of time.

30. A control unit in accordance with claim 29 wherein to apply the second direction torque to the motor, said control unit configured to apply the second direction torque to the motor for a second preselected period of time.

31. A control unit in accordance with claim 30 wherein the first preselected period of time equals the second preselected period of time.

32. A control unit in accordance with claim 25 wherein said control unit further comprises a counter, and wherein to initiate the start sequence of the motor, said control unit configured to:

start said timer;

initialize said counter to zero;

apply a series of signals to the motor so that the motor rotates in a first direction.

33. A control unit in accordance with claim 32 wherein to apply said series of signals to the motor, said control unit configured to generate a six step square waveform utilizing said control unit.

* * * * *

UNITED STATES PATENT AND TRADEMARK OFFICE

CERTIFICATE OF CORRECTION

PATENT NO. : 6,254,353 B1
DATED : July 3, 2001
INVENTOR(S) : Massimo Polo et al.

It is certified that error appears in the above-identified patent and that said Letters Patent is hereby corrected as shown below:

Column 14,
Line 41, delete "25" and insert therefor -- 23 --.
Line 51, delete "utilizing said control unit".

Signed and Sealed this

Second Day of September, 2003

JAMES E. ROGAN
*Director of the United States Patent and Trademark Office*